United States Patent [19]

Elfgen

[11] 4,298,233

[45] Nov. 3, 1981

[54] MILLING TOOL FOR A ROTATING MILLING CYLINDER

[76] Inventor: Gerd Elfgen, Theisenkreuzweg 10, 5303 Bornheim-Rösberg, Fed. Rep. of Germany

[21] Appl. No.: 46,328

[22] Filed: Jun. 7, 1979

[51] Int. Cl.[3] ..... E21C 35/18

[52] U.S. Cl. ..... 299/91; 175/383; 407/113

[58] Field of Search ..... 299/91–93, 299/89; 175/413, 383; 407/113, 114

[56] References Cited

U.S. PATENT DOCUMENTS 2,574,735 11/1951 Genter ..... 299/91 X 3,493,268 2/1970 Bower ..... 175/383 X 3,887,975 6/1975 Sorice et al. ..... 407/113 X 4,068,897 1/1978 Amoroso ..... 299/89 X

*Primary Examiner*—Ernest R. Purser

*Attorney, Agent, or Firm*—John S. Roberts, Jr.

[57] ABSTRACT

The invention relates to a milling tool for a rotating milling cylinder with milling head possibly equipped with hard metal, for milling away bonded mineral materials, having a stop part and retaining part for insertion into the radially outwardly open tool holder arranged on the milling cylinder circumference, in which holder the tool is arrestable by means of push-in bolts, while the retaining and stop part insertable into the tool holder is provided on each of its two ends with a milling head the maximum cross-sectional dimensions of which are such that they do not protrude beyond the cross-sectional area of the retaining and stop part, and the stop part finds its abutment in the tool holder.

9 Claims, 14 Drawing Figures

FIG. 7a
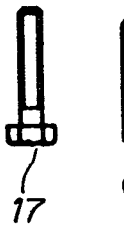
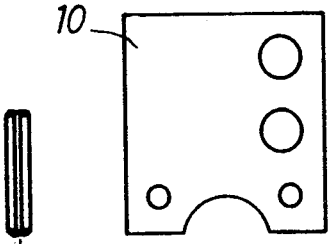
FIG. 7b
FIG. 7
FIG. 8
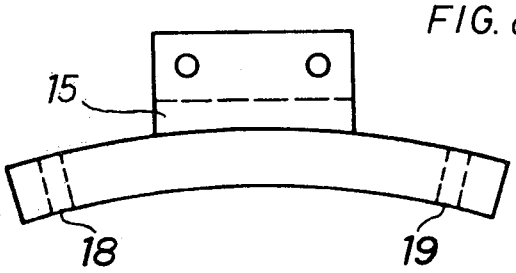
FIG. 9a
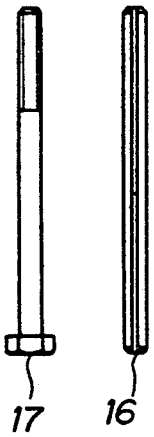
FIG. 9b
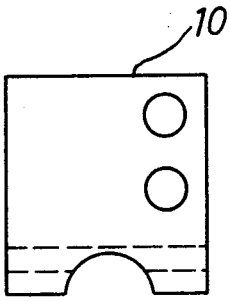
FIG.9
FIG. 10
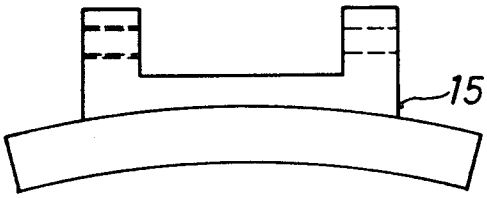

MILLING TOOL FOR A ROTATING MILLING CYLINDER

The invention relates to a milling tool for a rotating milling cylinder with milling head, possibly equipped with hard metal, for the milling away of bonded mineral materials, also the associated tool holder.

Milling tools of the kind in question are used especially in what are called road millers, with which the damaged road surface is milled away by a constant amount of a few centimeters, in order then to be coated with new material.

Although such milling ordinarily takes place with prior heating of the road surface, nevertheless the wear on milling tools is extraordinarily high.

Therefore the most various attempts have been made to reduce this wear on milling tools, and for this purpose it is usual to fit the milling head of the milling tool with hard metal.

On account of the relatively great forces which come to act upon the milling head, the retaining part of the milling tool and its fastening on the milling cylinder must be of very massive formation.

The retaining part of the milling tool therefore, as regards material, in comparison with the actual milling head constitutes the substantially larger part, which however ordinarily must likewise be thrown away after the milling head is worn out.

With regard to the relatively frequent replacement of the milling tools it is already usual to arrange the milling tool with a retaining part in a radially outwardly open tool holder which is arranged on the milling cylinder circumference, and to arrest it by means of a bolt which is inserted into a bore of the tool holder.

Now it is the problem of the present invention to produce a milling tool which on the one head can be inserted into this hitherto usual, radially outwardly open tool holder of milling cylinders and on the other hand renders possible a longer working life, as regards material.

This problem in accordance with the invention is solved with a milling tool of the above-explained kind which is characterised in that the retaining and stop part insertable into the tool holder is provided with a milling cutter head on each of its two ends, the maximum cross-sectional dimensions of which heads are such that they do not protrude beyond the cross-sectional area of the retaining and stop part and the stop part finds its abutment in the tool holder.

In a milling tool of such formation of double-sided use is possible, that is to say firstly a milling head can be used until it is completely worn away and then the milling tool is taken out of the tool holder and reversed, that is to say inserted with the worn out milling head first into the tool holder again and locked, and now it is possible to work with the second milling head until it is completely worn away.

The milling tool according to the present invention thus renders possible, in practice, double the working life before it is scrapped together with its retaining and stop part.

Due to the special dimensions of milling head, retaining part and stop part such simple refitting of the milling tool is possible, which was not the case with the milling tools known hitherto.

According to a further advantageous form of embodiment of the present invention it has proved especially expedient if the retaining part inserted into the tool holder is provided on the side remote from the milling surface with a flange which bears on the wall of the tool holder.

This flange, which according to a further advantageous form of embodiment of the present invention possesses a narrower width than the retaining part of the milling tool, so that insertion is facilitated, is subjected to especially heavy loading.

Therefore the flange can be manufactured from especially hard or especially tough material which may if necessary be brazed, welded, riveted etc. on to the retaining part.

The arrangement of the two milling heads, which can for example be mirror-symmetrical, of course likewise provides a flange bearing in the active position on the wall of the tool holder on the side remote from the milling surface, for the second milling head.

The flanges provided on one side in the case of such a mirror-symmetrical arrangement of the milling heads can possess an appropriate interspace in which a bolt arranged in appropriate bores of the tool holder makes the milling tool fast in the tool holder.

Such a bolt, which can consist for example of steel, serves at the same time as stop for the milling tool inserted into the tool holder.

On the other hand an additional stop can also be provided in the tool holder, on which for example the second flange on the lower milling head abuts.

In such a case for the retention of the tool in the tool holder it is sufficient if only a rubber bolt protects the milling tool against falling out.

According to a further advantageous form of embodiment of the present invention, in the milling tool the retaining and stop parts with the milling heads arranged on the end are made in each case rotationally symmetrical at 180°.

Such a form of embodiment renders possible a substantially more compact formation, especially of the retaining part, because thus for example the flanges provided on the side of the retaining part in each case remote from the milling surface are used for the supporting of the milling tool in the tool holder. The flange on the back of the active milling head bears on the upper edge of the tool holder, while the flange provided on the back of the milling head arranged in the tool holder takes up the counter-forces occurring in the lower part of the milling tool.

At the same time this latter flange can also bear on a stop provided in the tool holder, so that for the arresting of the milling tool in the tool holder only a rubber bolt is necessary which is inserted into corresponding bores of the tool holder, engages before the lower flange and secures the milling tool against falling out.

For the fitting of the milling tool, especially the exchanging of the milling heads, that is the taking of the milling tool out of the tool holder, it has proved especially advantageous if on at least one side of each milling head at the point protruding from the tool holder a recess is provided in which for example a screwdriver or similar tool can engage in order that the milling tool may thus be levered out of its retention.

It is naturally especially expedient if such a recess is provided on both mutually opposite sides of each milling head at the point protruding from the tool retention, since thus it is possible to engage two screwdrivers or similar tools at the same time and lever the milling tool out of its retention.

It has proved especially advantageous if the recesses are formed as wedges open towards the side of the milling head. A recess of such formation quite substantially facilitates the detaching of the milling tool.

With regard to the relatively great forces which come to act upon the milling tool in the milling away of road surfaces, the tool holders must be of very strong formation and they must further render possible rapid replacement of the milling tools because the latter are subjected to very heavy wear.

The tool holders known hitherto for this purpose for the milling tools of a road milling machine in fact possess the necessary strength to hold the milling tool securely and also permit a sufficiently rapid possibility of replacement of the milling tools.

When the milling tool of double-sided formation in accordance with the invention is used however difficulties in securing arise because the formerly usual supporting of the milling tool on the upper edge of the receiving part of sleeve form is no longer possible.

It is therefore the further problem of the present invention to produce a tool holder for milling tools which both can accommodate the milling tools usual hitherto and also renders possible the insertion of milling tools which are provided with a milling head at each end.

This problem is solved with a tool holder of the above-described kind for the milling tool according to the invention, which holder is characterised in that a stop for the milling tool is provided in the receiving body of sleeve form.

By such a transference of the stop into the receiving body of sleeve form the possibility is obtained of supporting a double-ended milling tool equally, in which case this supporting can consist for example of a projection protruding from the wall of the receiving body of sleeve form.

According to an especially advantageous form of embodiment of the present invention as stop there is provided a steel bolt which can be inserted into a transverse bore of the receiving body of sleeve form.

Such a steel bolt can be inserted or removed according to need, in dependence upon whether a milling tool of the former type of formation is used or whether a milling tool is to be used having a double-ended action according to the invention.

It has here proved expedient if the transverse bore for the steel bolt is arranged parallel with the transverse bore for the retaining bolt which in the manner usual hitherto is manufactured from elastic material, for example from a hard rubber, and makes either the hitherto usual milling tool or the new double-sided milling tool fast in the tool holder.

In the milling away of road surfaces the necessity frequently arises of cutting deeper at certain points of the width of the road in order that damage which has occurred where may be cut completely out of the road surface and replaced by new material.

For this purpose longer milling tools must be used at specific points of the milling cylinder.

In order to conform with this requirement hitherto the tool holder screwed on to the milling cylinder was removed, by release of the retaining screws, and replaced by a new tool holder having a greater length, so that the milling tool protruding from the tool holder mills away the road surface more deeply than the other milling tools.

The detaching of the tool holders screwed on to the milling cylinder is a very time-consuming task and furthermore in the case of frequent exchanging of the tool holder the threading ordinarily cut into the milling cylinder is worn away, so that after a certain time the securing of the tool holders no longer possesses the necessary firmness.

These difficulties are avoided according to a further advantageous form of embodiment of the tool holder in accordance with the invention in that the receiving body of sleeve form is pushed on to a foot secured on the milling cylinder and held by clamping pins or clamping screws which are provided in bores in the foot and in the receiving body of sleeve form which are arranged parallel with the axis of the milling cylinder.

In the case of such securing of the receiving body of sleeve form this body can be detached relatively easily and quickly by knocking out of the clamping pins or unscrewing of the clamping screws, without detriment in any way to the durability of the connection between milling cylinder and foot of the tool holder. Furthermore in the case of frequent replacement of the receiving body of sleeve form only the easily replaced clamping pin or the easily replaced clamping screw wears, so that the above-described difficulties are reliably avoided with this form of embodiment of the tool holder in accordance with the invention.

It has further appeared that the connection between the foot of the tool holder and the receiving part of sleeve form, achieved by clamping pins or clamping screws, can further be improved in that the receiving body of sleeve form is pushed on to a foot secured on the milling cylinder and held by clamping pins or screws which are provided in bores arranged tangentially of the milling cylinder axis in the foot and in the receiving body of sleeve form.

When milling tools having two cutter heads are used, the milling tool is supported solely in the receiving body of sleeve form. Therefore the upper edge of the receiving body is especially heavily loaded, especially as the part abutting on the back of the milling head, which can lead to this area being hammered out after lengthy use.

According to a further advantageous form of embodiment of the present invention the part of the receiving body of sleeve form where the back of the milling tool is supported, is provided with a replaceable support plate. Such a support plate can for example be let into the wall of the receiving body of sleeve form and secured by means of screws, bolts, rivets and the like. On the other hand a cover plate provided with a clamping strap can be fitted on to the edge of the receiving body of sleeve form, in which case the clamping strap or an angled-off part of the cover plate snaps into a corresponding recess on the outside of the receiving body or in the inner wall of the receiving body.

Such a cover plate protects the edge and wall of the receiving body lying under it and can easily be replaced when it is deformed by the forces acting constantly thereon.

The bores provided in the receiving body of sleeve form for the reception of the retaining bolt and for the reception of the stop bolt can comprise corresponding grooves in which clamp rings and the like engage which arrest the inserted bolts against lateral displacement.

It has however appeared that the arresting of these bolts against lateral displacement can be brought about in a simple manner according to a further advantageous form of embodiment of the present invention in that the bores provided in the receiving body of sleeve form comprise additional recesses at the ends into which cover caps, which can consist for example of synthetic plastics material, are pressed. Such cover caps firstly prevent lateral displacement of the inserted bolts and thus also unintentional slackening and falling out of the bolts, moreover they prevent soiling of these bores, which could lead to difficulties in the replacement of the milling tools.

The invention will be explained in greater detail hereinafter by reference to the examples of embodiment illustrated in the accompanying drawings, wherein.

FIGS. 7, 7*a* and 7*b* show an illustration of details of the receiving body of sleeve form with clamping pin and clamping screw;

FIG. 8 shows a lateral elevation of the foot of the tool holder for fitting on the milling cylinder;

FIGS. 9, 9*a* and 9*b* show another form of embodiment of the receiving body of sleeve form of the tool holder with clamping pin and clamping screw;

FIG. 10 shows another form of embodiment of the foot of the tool holder for fitting on the milling cylinder.

Figure 1:
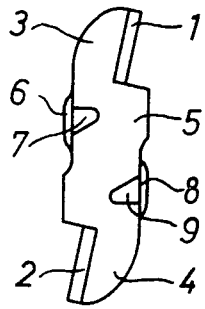
FIG. 1 shows a lateral elevation of a milling tool according to the present invention.
Figure 2:
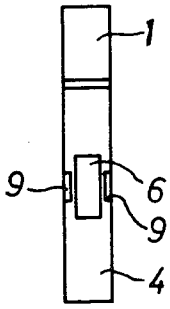
FIG. 2 shows a front elevation of the milling tool according to the invention.

The milling tool as illustrated in FIG. 1 comprises two milling heads 3 and 4 fitted with hard metal plates 1 and 2 and connected with one another through a retaining part 5. The arrangement of the two milling heads 3 and 4 on the retaining part 5 is made rotationally symmetrical.

On the side of the retaining part 5 remote from the hard metal plate 1 of the milling head 3 a flange 6 is provided which bears on the wall of the tool holder, in the inserted condition.

The side wall of the retaining part 5 has, approximately at the level of the flange 6, a wedge-shaped recess 7 open to the edge which serves for the easier release of the milling tool from the tool holder.

On the side of the retaining part remote from the hard metal plate 2 of the milling head 4 a further flange 8 is provided which in the inserted condition supports the retaining part on the wall of the tool holder.

At the level of this flange in the side wall of the retaining part there is likewise again provided a recess 9 open in wedge form to the edge.

Figure 3:
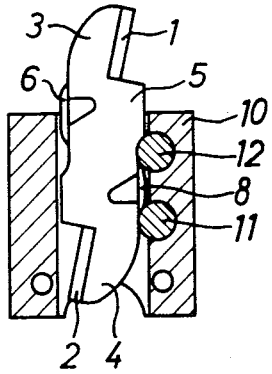
FIG. 3 shows a lateral elevation of the milling tool inserted into the tool holder, in section.

In FIG. 3 there is illustrated the arrangement of the milling tool according to the invention in the tool holder 10. A steel pin 11 inserted into bores of the tool holder 10 serves as stop for the flange 8 and with the latter constantly newly determines the reference point for the arrangement of the milling tool in the tool holder 10.

For the arresting of the milling tool in the tool holder, in a further bore in the tool holder 10 there is arranged a rubber bolt 12 which makes the flange 8 fast and thus secures the milling tool against falling out.

Between the two bolts 11 and 12 the flange 8 supports itself against the wall of the tool holder and thus, together with the flange 6 arranged on the back of the milling tool and bearing on the opposite side of the tool holder 10, takes up the forces coming to act upon the hard metal plate 1 of the milling tool.

Figure 4:
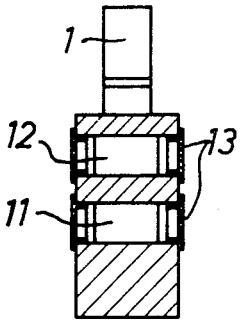
FIG. 4 shows a lateral elevation of the tool holder for fitting on the milling cylinder, with inserted milling tool.

As may be seen from FIG. 4 the bolts 11 and 12 inserted in the wall of the holder are each secured against falling out by means of correspondingly formed cover caps 13, which may be manufactured from synthetic plastics material.

Figure 5:
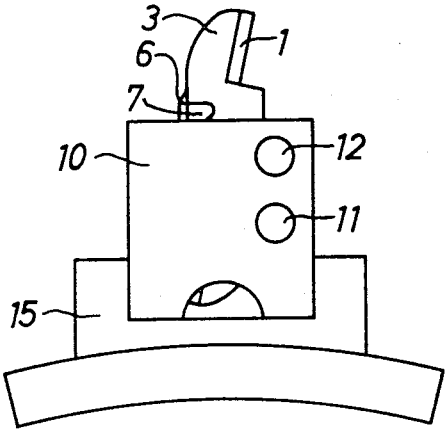
FIG. 5 shows a front elevation of the milling tool as illustrated in FIG. 3 with tool holder, in section.

In FIG. 5 there is illustrated the arrangement of the tool holder 10 with inserted milling tool on the milling cylinder.

Figure 6:
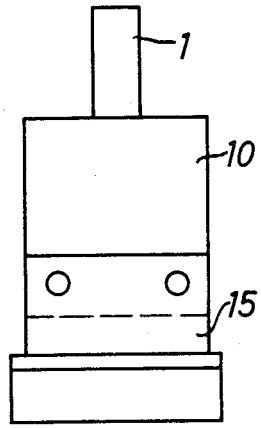
FIG. 6 shows a front elevation of the tool holder with inserted milling tool, as illustrated in FIG. 5.

In this case, as may also be seen from FIG. 6, the tool holder 10 is detachably secured on a special foot 15 provided on the milling cylinder.

In FIG. 7 the tool holder 10 is again illustrated with the corresponding bores for its securing on the foot 15 provided on the milling cylinder, also a clamping pin 16 and a clamping screw 17.

FIG. 8 shows the foot 15 of the tool holder 10 with the bores for the reception of clamping pin 16 and/or clamping screw 17 and the indicated bores 18, 19 for the securing of the foot 15 on the milling cylinder.

In the form of embodiment as illustrated in FIG. 9 the bores for the reception of clamping pin 16 and clamping screw 17 extend tangentially of the longitudinal axis of the milling cylinder. Corresponding bores are also to be found in the foot 15 for screwing on the milling cylinder, according to FIG. 10, on which foot the receiving body of sleeve form can be fitted according to FIG. 9 and made fast with the clamping screw 17.

I claim:

1. A milling tool for insertion into a tool holder having an opening for receiving said tool, comprising an elongated body having a rectangular cross-section, a milling cutting head disposed at each end thereof, said heads being dimensioned so as not to protrude beyond said rectangular cross-section, a protuberance provided on opposite sides of the body adjacent and below the cutting heads, said tool holder having a partial opening extending through the wall therein, stop means disposed in said partial opening and being configured to fill the partial opening with a part thereof extending into said tool holder opening, said stop means engaging one of said abutments when the body is positioned in said tool holder opening whereby the opposite abutment engages another part of the wall of said tool holder opening thereby effecting the holding of the body in the opening.

2. The milling tool according to claim 1, characterized in that the body is provided on its side facing the milling surface with a recess for the reception of an arresting bolt, said arresting bolt being disposed above said stop means and capturing said one of said abutments therebetween.

3. The milling tool according to claim 1, characterized in that the body with the milling heads arranged on the ends is made rotationally symmetrical by 180°.

4. The milling tool according to claim 1, characterized in that a recess is provided on at least one side of each milling head at the point extending above the tool holder when said head is protruding therefrom.

5. The milling tool according to claim 4, wherein a recess is provided on the other side of said milling head, with said recesses being wedge-shaped open to the head respectively.

6. The tool holder for the milling tool according to claim 1, wherein the tool holder is a sleeve, rectangular in cross-section, having a transverse bore for receiving said stop means, said stop means comprising a steel bolt disposed in said bore.

7. The tool holder according to claim 1, characterized in that the tool holder is of sleeve form and is disposed on a foot secured on a milling cylinder held thereon by clamping pins and screws positioned in bores arranged parallel with the milling cylinder axis in the foot and in the sleeve.

8. The tool holder according to claim 7, characterized in that the receiving body of sleeve form is pushed onto a foot secured on the milling cylinder and is held by clamping pins or screws which are provided in bores arranged tangentially of the milling cylinder axis in the foot and in the receiving body of sleeve form.

9. The tool holder according to one of claims 7 or 8 characterized in that the part of the receiving body of sleeve form on which the back of the milling tool is supported is provided with a replaceable support plate.

* * * * *